United States Patent [19]

Lash

[11] 4,151,039

[45] Apr. 24, 1979

[54] DOUBLE ADHESIVE TAPE DISPENSER

[76] Inventor: Donald W. Lash, 4443 Poinsettia, SE., Kentwood, Mich. 49508

[21] Appl. No.: 910,745

[22] Filed: May 30, 1978

[51] Int. Cl.[2] ..... B32B 35/00; B65N 5/28; B65N 17/02

[52] U.S. Cl. ..... 156/584; 221/71; 242/67.3 R

[58] Field of Search ..... 156/527, 577, 584; 242/67.3; 221/71, 72, 73, 74

[56] References Cited

U.S. PATENT DOCUMENTS

| | | | |
|---|---|---|---|
| Re. 25,056 | 10/1961 | Fritzinger | 156/584 |
| 2,325,400 | 7/1943 | Hoover | 242/67.3 R |
| 2,652,115 | 9/1953 | Mysels | 225/24 |
| 3,136,462 | 6/1964 | Knutson | 156/527 |
| 3,658,628 | 4/1972 | Zenter | 156/527 |

*Primary Examiner*—Douglas J. Drummond
*Attorney, Agent, or Firm*—Blanchard, Flynn, Thiel, Boutell & Tanis

[57] ABSTRACT

A tape dispenser which includes a portable frame having a single upright sidewall and an upwardly projecting front wall provided with a cutting blade adjacent the upper edge thereof. A pair of horizontally cantilevered spindle assemblies are rotatably supported on the sidewall in parallel but horizontally spaced relationship. One of the spindle assemblies, as positioned more closely adjacent the cutting blade, has a rotatable support roller on which a tape spool is removably positioned. This support roller also has a large diameter annular hub disposed in engagement with an endless drive belt. The other spindle assembly includes a rotatable takeup roller which is of a diameter similar to that of the support roller. This takeup roller, which is adapted to have the tape backing strip wound thereon, has a small diameter hub disposed in engagement with the drive belt. The backing strip leads directly from the support roller to the takeup roller so as to be wound thereon, whereas the adhesive tape leads directly from the support roller toward the front wall so as to pass over the cutting blade.

8 Claims, 2 Drawing Figures

DOUBLE ADHESIVE TAPE DISPENSER

FIELD OF THE INVENTION

This invention relates to a dispensing device for use with a roll of tape having an adhesive surface which is protectively covered by a removable backing strip and, in particular, to an apparatus which permits dispensing of the tape while effecting automatic removal of the backing strip.

BACKGROUND OF THE INVENTION

Adhesive or pressure sensitive tape is conventionally provided in roll form. A removable backing strip is also commonly utilized for protecting an adhesive surface on the tape, particularly where the tape is provided with adhesive films on both surfaces thereof, commonly referred to as double-stick tape, since one of these surfaces is covered by a removable backing strip to permit the tape to be stored in roll form. Such double-stick tape is well known and extensively utilized.

To permit handling and dispensing of such double-stick tape, various dispensing devices have been proposed which employ a support roller on which the tape roll is mounted, and which also employ a takeup roller on which the backing strip is wound during dispensing of the tape. These known dispensers, however, have normally been structurally complex, and in addition have been undesirably bulky and space consuming. Further, these known dispensers have not permitted the backing strip to be efficiently and automatically removed from the adhesive surface of the tape during the dispensing operation, with the backing strip itself being automatically rewound onto a takeup roller for disposal.

In addition, the known tape dispensers of this general type have been relatively expensive to construct, have been more difficult to load with tape and manipulate, and have not possessed the portability, lightweight and durability required under many of the working conditions where dispensers of this type would otherwise be widely utilized.

Accordingly, it is an object of this invention to provide an improved dispenser for use with a roll of adhesive tape, and in particular a roll of adhesive tape provided with a removable backing strip, which apparatus permits the efficient dispensing of the adhesive tape while simultaneously effecting removal of the backing strip and winding thereof on a takeup roller.

Another object is to provide an improved dispenser, as aforesaid, which includes both a rotatable support roller for the tape spool and a rotatable takeup roller for the backing strip, which rollers are simultaneously driven by an intermediate drive structure in response to the manual removal of tape from the tape spool, and which drive structure includes means permitting slippage of one of the rollers during winding of the backing strip on the takeup roller to compensate for variations caused by the different and varying diameters of the support and takeup rollers during the dispensing operation.

A further object is to provide an improved dispenser, as aforesaid, which can be manufactured inexpensively, is extremely durable in operation, is lightweight and portable so as to be readily moved about for use where desired, is durable in operation, and can be easily and efficiently serviced and reloaded with tape when necessary.

Other objects and purposes of the invention will be apparent to persons familiar with dispensers of this general type upon reading the following specification and inspecting the accompanying drawings.

Figure 2:
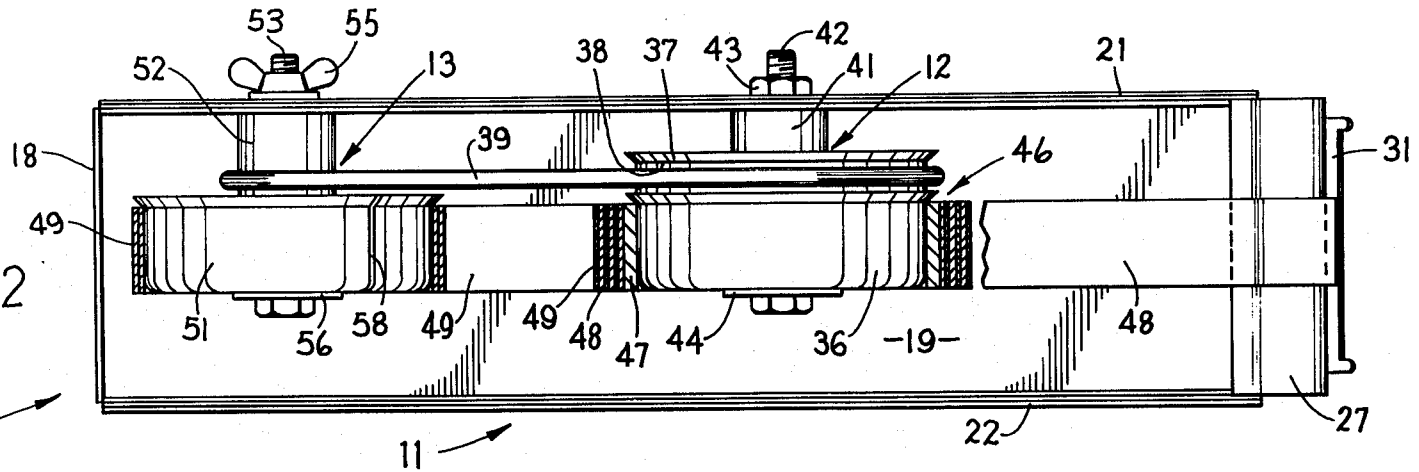
FIG. 2 is a plan view of the dispenser.

Certain terminology will be used in the following description for convenience in reference only and will not be limiting. For example, the words "rightwardly," "leftwardly," "upwardly" and "downwardly" will refer to directions in the drawings to which reference is made. The words "inwardly" and "outwardly" will refer to directions toward and away from, respectively, the geometric center of the apparatus and designated parts thereof.

SUMMARY OF THE INVENTION

The objects and purposes of this invention, including those mentioned above, have been met by a dispenser which includes a small and portable frame having a single upright sidewall and an upwardly projecting front wall provided with a cutting blade adjacent the upper edge thereof. A pair of horizontally cantilevered spindle assemblies are rotatably supported on the sidewall in parallel but horizontally spaced relationship. One of the spindle assemblies, as positioned more closely adjacent the cutting blade, has a rotatable support roller on which a tape spool is removably positioned. This support roller also has a large diameter annular hub disposed in engagement with an endless drive belt. The other spindle assembly includes a rotatable takeup roller which is of a diameter similar to that of the support roller. This takeup roller, which is adapted to have the backing strip wound thereon, has a small diameter hub disposed in engagement with the drive belt. The backing strip leads directly from the support roller to the takeup roller so as to be wound thereon, whereas the adhesive tape leads directly from the support roller toward the front wall so as to pass over the cutting blade. Manually pulling on the free end of the adhesive tape to remove same from the spool causes rotation of the support roller, which in turn drives the takeup roller through the drive belt to thereby automatically remove the backing strip from the adhesive tape and wind same around the takeup roller. Since the diameter of the tape spool continuously decreases during dispensing while the diameter of the backing strip on the takeup roller continuously increases, the continual driving of the takeup roller by the support roller always insures that the backing strip is maintained under sufficient tension as to be automatically separated from the adhesive tape and wound around the takeup roller. Inasmuch as the driving hubs on the two rollers are of different diameters, the drive belt will always exert a driving force on the takeup roller. However, the tension in the backing strip as wound on the takeup roller acts to retard the rotation of the takeup roller, resulting in slippage between the drive belt and the takeup roller.

DETAILED DESCRIPTION

The tape dispenser 10 includes a compact and lightweight frame 11 having supported thereon main and secondary spindle assemblies 12 and 13, respectively. These spindle assemblies project horizontally and are disposed in horizontally spaced, parallel relationship.

The frame 11 is formed primarily from an upwardly opening U-shaped frame member 16 which includes substantially parallel upright front and rear walls 17 and 18, respectively, rigidly and integrally joined together by a bottom wall 19. This frame member 16 is rigidly joined, as by welding, to a substantially planar side frame member 21 which is disposed vertically and defines a sidewall which closes one end of the U-shaped frame member 16 and extends between the front and rear walls thereof. The other end of the U-shaped frame member 16 is open, except for a small reinforcing angle 22 which is fixed to the exposed edge of the U-shaped frame member 16, whereby the spindle assemblies 12 and 13 are thus readily accessible from both the top and side of the frame. Appropriate support feet 23 are fixed to the bottom wall 19 for supporting the dispenser on any convenient surface, such as a counter, table or the like.

The front wall 17 includes a lower planar portion 25 which projects substantially vertically and terminates in an upper planar portion 26 which is inclined forwardly at a slight angle relative to the lower wall portion 25. This upper wall portion 26 in turn has the upper edge thereof fixedly, here integrally, connected to a substantially planar tape support flange 27 which extends inwardly in substantially perpendicular relationship to the wall portion 26.

A cutting blade 31 is fixed to and extends longitudinally along the front side of the upper wall portion 26, which cutting blade 31 is provided with a conventional upper cutting edge, such as a serrated cutting edge, disposed slightly upwardly above the upper surface of the tape support flange 27. The cutting blade 31 is confined between the wall portion 26 and a blade guard 32. Bolts 33 extend through these latter-mentioned members for fixedly holding the cutting blade in the desired position. The structure of the cutting blade and blade guard is conventional, and is illustrated in greater detail in my earlier U.S. Pat. No. 3,768,713.

The main spindle assembly 12 includes a rather large diameter support roller 36 which is provided with an annular hub or pulley 37 at one end thereof. This hub 37 is of a diameter similar to that of the support roller 36 and is provided with an annular groove 38 therein for confining and drivingly engaging an endless drive band 39. This drive band 39 is disposed in frictional engagement with the hub 37 and, as illustrated, the band 39 comprises an endless belt which is preferably constructed of rubber or like material, with the belt preferably having a circular cross section.

The support roller 36 and its associated hub 37 is nonrotatably mounted on an elongated sleevelike spindle 41, which spindle in turn is rotatably supported on an elongated bolt 42 which is fixed to and projects horizontally in cantilever relationship from the sidewall 21 so that the complete spindle assembly 12 is thus supported in a horizontally cantilevered relationship from the sidewall 21. The bolt 42 has a nut 43 fixed thereto for fixedly mounting the bolt relative to the sidewall. An annular washer 44 is preferably disposed between the head of the bolt and the adjacent end of the spindle 41.

The support roller 36 is adapted to have a conventional tape spool or roll 46 mounted thereon. This tape spool 46, as is conventional, includes a central cylindrical core 47 which is adapted to snugly fit on the support roller 36 and around which an elongated adhesive or pressure sensitive tape 48 is spirally wound. The tape 48, in the illustrated embodiment, is of the double-stick type in that the opposite surfaces of the tape are both provided with an adhesive film or layer, and an appropriate protective backing strip 49 covers one of these adhesive surfaces to permit the tape to be spirally wound within a roll. Such tapes are well known, and hence require no further description.

Considering now the secondary spindle assembly 13, same includes a takeup roller 51 which is of substantially the same diameter as the support roller 36, with these rollers also being of the same axial width. The takeup roller 51 is nonrotatably supported on a sleevelike spindle 52, which latter spindle is in turn rotatably supported on an elongated bolt 53 which is fixed to the sidewall 21 and projects horizontally therefrom in a cantilevered manner. The threaded end of bolt 53 projects through an elongated slot 54 formed in the sidewall, which slot extends perpendicular with respect to and substantially intersects the rotational axes of the spindle assemblies 12 and 13, which axes are substantially parallel. An appropriate wing nut 55 is engageable with the free end of the bolt 53 to thereby fixedly secure the latter with respect to the sidewall 21. In addition, a conventional annular washer 56 is preferably disposed between the head of the bolt 53 and the adjacent end of the spindle 52.

As illustrated in FIG. 2, the spindle 52 functions as a hub for the takeup roller 51, with this hub being of substantially smaller diameter than the takeup roller and being provided with a relatively smooth cylindrical exterior surface. The drive belt 39 extends around and is in frictional driving engagement with the peripheral surface of the spindle 52 so as to effect rotation of the takeup roller 51 responsive to rotation of the support roller 36.

Figure 1:
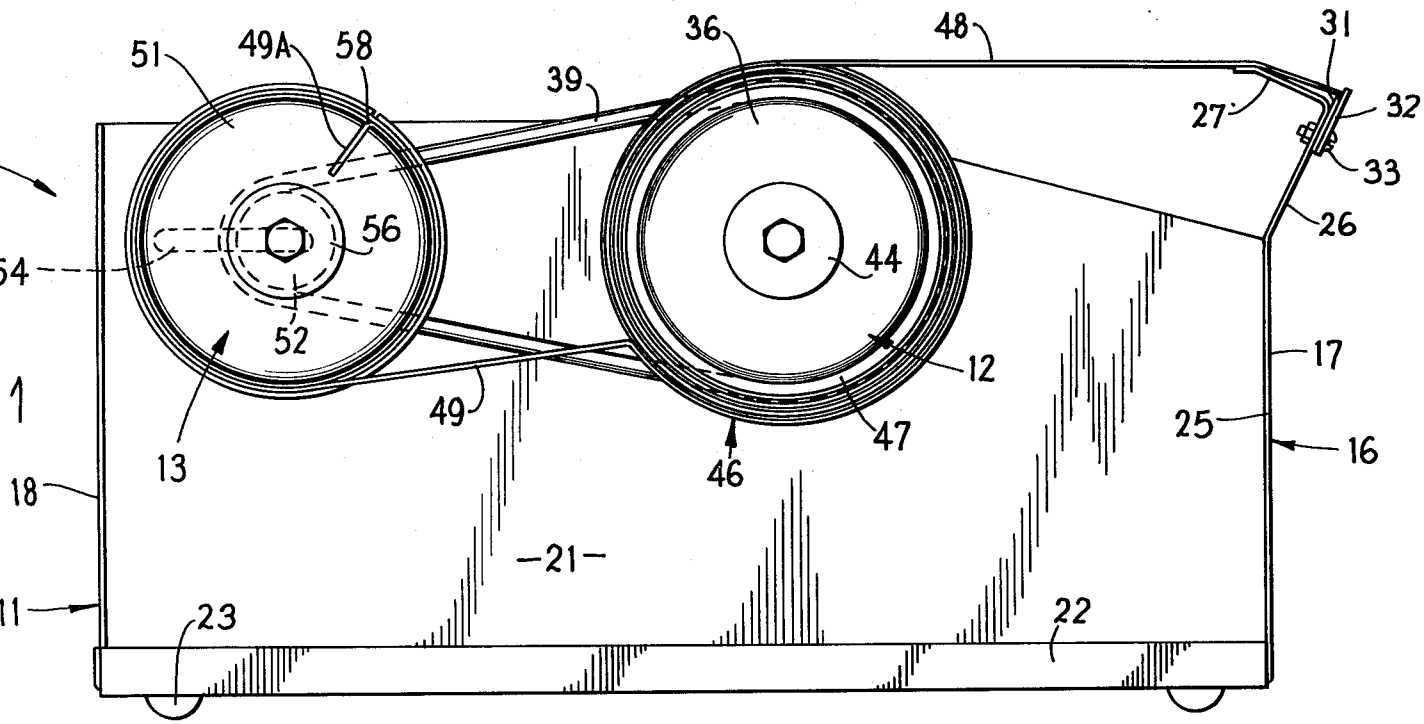
FIG. 1 is a front elevational view of the dispenser.

The cylindrical periphery of support roller 51 has a slit 58 extending radially therethrough whereby the free end 49A of the backing strip 49 can be inserted therethrough, as indicated in FIG. 1, to permit winding of the backing strip on the takeup roller.

In the illustrated embodiment, the support roller 36 and takeup roller 51 are approximately three inches in diameter, as is the hub 37 associated with the support roller. The hub or spindle 52 associated with the takeup roller 51 is, on the other hand, about one inch in diameter. Thus, whenever, roller 36 is rotated due to a manual pulling or dispensing of tape, which in turn causes rotation of hub 37 and driving of belt 39, then the latter drives the spindle 52 and the takeup roller 51. Since the hub or spindle 52 is of substantially smaller diameter than the driving hub 37, any necessary slippage or relative rotation between the rollers 36 and 51 will normally occur between the belt 39 and the hub 52 due to the smaller area of frictional engagement therebetween.

OPERATION

In operation, the tape roll or spool 46 is slid onto the support roller 36 so that the core 47 snugly engages the support roller, resulting in the support roller 36 and tape spool 46 being relatively nonrotatable with respect to one another. The free end of the tape and adhered backing strip is then partially removed from the roll, and the backing strip 49 is separated from the adhesive tape 48. The free end 49A of the backing strip 49 is then fed across from the lower extremity of the spool 46 and wrapped partially around the takeup roller 51, in a clockwise direction, until the free end 49A can be inserted into the slit 58, thereby anchoring the backing strip to the takeup roller. The tape 48, and particularly that portion of the tape from which the backing strip has been removed, continues in a clockwise direction around the spool 46 and is then separated from the spool adjacent the upper part thereof, with the tape 48 then being pulled forwardly (rightwardly in FIGS. 1 and 2) so as to pass over the support flange 27 and the cutting edge 31. The tape 48, adjacent the free end thereof, contacts and lightly adheres to the flange 27 so that the tape 48 will thus be in position to permit same to be manually engaged and readily dispensed. It should be noted that the underside of the tape 48 adhesively engages the flange 47, which underside is opposite the adhesive surface of the tape from which the backing strip 49 has already been removed.

With the dispenser in the operational position as described above, and as illustrated in FIGS. 1 and 2, it is then only necessary to manually engage the tape 48 in the vicinity of the support flange 27. By slightly lifting upwardly, this releases the tape from the stop flange 27 and by manually pulling on the tape 48, the necessary or desired length thereof can be removed from the spool 46, following which the tape is pulled downwardly across the blade 31 so as to sever the removed strip from the spool. During this cutting or severing, the tape segment which extends between the cutting blade 31 and the spool 46 contacts the support flange 27 and is deflected from a straight line path. This flange 27 holds the free end of the tape 48 in the illustrated extended position.

When the tape is being pulled from the spool as above described, the tape spool 46 and support roller 36 rotate in a clockwise direction, causing a corresponding rotation of the hub 37 and a driving of the belt 39. This in turn causes a corresponding clockwise rotation of the takeup roller 51 so as to cause the backing strip 49 to be wound therearound, which winding of the backing strip around the takeup roll causes the backing strip to be automatically disengaged from the tape 48 just prior to the removal of the tape from the spool.

Since the hub or spindle 52 is of substantially smaller diameter than the driving hub 37, the belt 39 will thus tend to drive the takeup roller 51 at a rotational speed substantially greater than that of the support roller 36. In this manner, the support roller 51 will always exert a pulling force on the backing strip 49 to thereby effectively separate same from the tape 48. When the tension in the backing strip 49 reaches a preselected amount, such as when the backing strip 49 effectively extends tangentially between the lower peripheries of the takeup roller 51 and the spool 46, then limited slippage will occur between the belt 39 and the spindle 52 so as to compensate for the difference in the rotation velocities between the support and takeup rollers.

Since the frame 11 is small, compact, and light in weight, it can be readily moved about and positioned as desired to permit efficient utilization of the dispenser. At the same time, since the spindle assemblies cantilever outwardly from the sidewall 21, with the other side of the frame being completely open, the support and takeup rollers are readily visible and accessible to permit convenient replacement of the tape spool.

If necessary, the frame 11 can be provided with an appropriate counter-weight mounted thereon, such as by positioning a counter-weight on the bottom wall 19 adjacent the rear wall 18.

When the tape spool 46 has been emptied of tape, then the empty core 47 is slidably removed from the support roller 36 and a new tape spool is repositioned thereon. The spirally wound backing strip on the support roll 51 is similarly removed, as by axially sliding the wound backing strip axially downwardly in FIG. 2, so that the backing strip of the new tape spool can be fed to and wound around the takeup roller.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A portable dispenser for dispensing double-coated adhesive tape wound in a roll with a removable backing strip, comprising:

a portable frame including a bottom wall, and a sidewall fixed to the bottom wall and projecting upwardly therefrom in substantially perpendicular relationship;

tape cutting means fixedly mounted on said frame adjacent one end thereof, said tape cutting means including an elongated cutting bar having an elongated upper cutting edge extending substantially horizontally, said cutting edge being spaced upwardly from said bottom wall and extending substantially perpendicularly with respect to said sidewall;

first cantilevered spindle means mounted on said sidewall and projecting horizontally outwardly thereof in substantially perpendicular relationship thereto, said first cantilevered spindle means being adapted to have said roll mounted thereon;

second cantilevered spindle means mounted on said sidewall and projecting horizontally outwardly therefrom in substantially perpendicular relationship thereto, said first and second spindle means being disposed in radially spaced but substantially parallel relationship, and said second spindle means being adapted to wind thereon the backing strip after same has been separated from the adhesive tape;

said first cantilevered spindle means including a first support shaft fixed to and projecting horizontally and perpendicularly outwardly from one side of said sidewall, and a support roller rotatably supported on said first support shaft, said support roller being adapted to have said roll of tape removably positioned thereon for rotation therewith;

said second spindle means including a second cantilevered support shaft fixed to and projecting horizontally and perpendicularly outwardly from said one side of said sidewall, and a takeup roller rotatably supported on said second support shaft, said takeup roller having means associated therewith for permitting the backing strip to be wound therearound, said takeup and support rollers being of similar diameter;

drive means for drivingly connecting said takeup and support rollers to cause rotation of said takeup roller in response to rotation of said support roller, said drive means including a first annular belt-engaging pulley coaxial with and nonrotatably connected to said support roller, a second annular belt-engaging pulley coaxial with and nonrotatably connected to said takeup roller, said second pulley being of substantially smaller diameter than said first pulley, and an endless friction-type drive belt extending between and being in driving engagement with said first and second pulleys, the driving transmission between said pulleys and said belt being due solely to the frictional engagement therebetween; and engaging means for deflecting and engaging the length of tape which extends between the support roller and the cutting edge, said engaging means including a tape support member positioned closely adjacent said cutting edge in the region between said cutting edge and said support roller, said tape support member being stationarily fixed relative to said frame at an elevation whereby it causes the tape segment which extends from said support roller to said cutting edge to engage said support member and to be deflected from a straight line path in order to permit the tape to be engaged with the cutting edge.

2. A dispenser according to claim 1, wherein said frame has only one said sidewall, and the region adjacent the free ends of said first and second spindle means being totally open to permit free access to the support and takeup rollers.

3. A dispenser according to claim 2, wherein said first and second spindle means are disposed with their longitudinal axes in substantially the same horizontal plane, said first spindle means being positioned horizontally between said second spindle means and said cutting blade, and said cutting edge being positioned at an elevation above said horizontal plane.

4. A dispenser according to claim 3, wherein said frame includes front and rear walls fixed to and projecting perpendicularly upwardly from said bottom wall adjacent the opposite ends thereof, said front and rear walls also being fixed to said sidewall adjacent the opposite ends thereof, whereby said front and rear walls in conjunction with said sidewall and said bottom wall define an upwardly opening rectangular box-like structure which is totally open on the side thereof opposite said sidewall.

5. A dispenser according to claim 4, wherein said front wall has a lower planar wall portion which projects upwardly in perpendicular relationship to the bottom wall and terminates in an upwardly projecting upper planar wall portion which is angled outwardly at a small angle relative to the vertical, said cutting blade being mounted on said upper wall portion adjacent the upper edge thereof, and said engaging means comprising a planar platelike flange fixed to said upper wall portion adjacent the upper end thereof and projecting inwardly therefrom in perpendicular relationship thereto.

6. A dispenser according to claim 1, wherein said first and second spindle means respectively include identical first and second elongated sleevelike spindles which are rotatably supported on said first and second support shafts, respectively, said support roller surrounding and being nonrotatably connected to said first spindle, said first pulley and said support roller being of similar diameters, said takeup roller being mounted on and nonrotatable relative to said second spindle, said second spindle defining said second pulley and having said drive belt disposed in frictional driving engagement therewith.

7. A dispenser according to claim 6, including adjustment means coacting between said sidewall and one of said support shafts for permitting the spacing between said support shafts to be selectively adjusted.

8. A dispenser according to claim 7, wherein said support shafts are disposed with their longitudinal axes within a common horizontal plane which is disposed at an elevation below said cutting edge, and said first spindle means being located substantially horizontally midway between said cutting edge and said second spindle means.

* * * * *